US008331839B2

(12) United States Patent
Kunii et al.

(10) Patent No.: US 8,331,839 B2
(45) Date of Patent: Dec. 11, 2012

(54) GLOSS APPLICATOR AND IMAGE FORMING APPARATUS

(75) Inventors: Hiroyuki Kunii, Kanagawa (JP); Akiyasu Amita, Kanagawa (JP); Shuntaroh Tamaki, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 141 days.

(21) Appl. No.: 12/929,326

(22) Filed: Jan. 14, 2011

(65) Prior Publication Data

US 2011/0188911 A1 Aug. 4, 2011

(30) Foreign Application Priority Data

Feb. 1, 2010 (JP) ..... 2010-020762

(51) Int. Cl.
*G03G 15/20* (2006.01)

(52) U.S. Cl. ..... 399/323; 399/341

(58) Field of Classification Search ..... 399/323, 399/341, 342, 361, 405
See application file for complete search history.

(56) References Cited

U.S. PATENT DOCUMENTS

| | | | |
|---|---|---|---|
| 6,813,464 | B2 | 11/2004 | Amita et al. |
| 6,957,036 | B2 | 10/2005 | Kikuchi et al. |
| 7,010,257 | B2 | 3/2006 | Someya et al. |
| 7,031,648 | B2 | 4/2006 | Takashi et al. |
| 7,054,570 | B2 | 5/2006 | Kishi et al. |
| 7,116,923 | B2 | 10/2006 | Kishi et al. |
| 7,127,202 | B2 | 10/2006 | Fujita et al. |
| 7,130,555 | B2 | 10/2006 | Kishi et al. |
| 7,139,520 | B2 | 11/2006 | Echigo et al. |
| 7,177,580 | B2 | 2/2007 | Nakafuji et al. |
| 7,209,675 | B2 | 4/2007 | Matsusaka et al. |
| 7,212,758 | B2 | 5/2007 | Kishi et al. |
| 7,212,759 | B2 | 5/2007 | Kishi et al. |
| 7,233,762 | B2 | 6/2007 | Kunii et al. |
| 7,239,821 | B2 | 7/2007 | Matsusaka et al. |
| 7,254,362 | B2 | 8/2007 | Kikuchi et al. |
| 7,269,384 | B2 | 9/2007 | Someya et al. |
| 7,299,003 | B2 | 11/2007 | Kurotaka et al. |

(Continued)

FOREIGN PATENT DOCUMENTS

JP 4307888 A 10/1992

(Continued)

OTHER PUBLICATIONS

Abstract of JP 2004-004746 published on Jan. 8, 2004.

*Primary Examiner* — Walter L Lindsay, Jr.
*Assistant Examiner* — Billy J Lactaoen
(74) *Attorney, Agent, or Firm* — Harness, Dickey & Pierce, P.L.C.

(57) ABSTRACT

A gloss applicator, disposed downstream from a fusing device for fusing a non-fused image on a recording medium, includes a pair of pressure units, an endless belt, and a belt suction unit. The pair of pressure units define a gloss nip therebetween through which the recording medium is passed to enhance glossiness of the fused image. The endless belt, disposed in one of the pressure units in an extended loop configuration, transports the recording medium thereon. An outer face of the endless belt can contact the fused image on the recording medium. The belt suction unit, disposed inside the endless belt loop, exerts suction on the endless belt to locally deform a given portion of the endless belt and separate the recording medium from the endless belt at the given portion as a separation position.

11 Claims, 8 Drawing Sheets

U.S. PATENT DOCUMENTS

| | | | |
|---|---|---|---|
| 7,308,216 | B2 | 12/2007 | Kishi et al. |
| 7,333,743 | B2 | 2/2008 | Kishi et al. |
| 7,333,760 | B2 | 2/2008 | Baba et al. |
| 7,343,113 | B2 | 3/2008 | Matsusaka et al. |
| 7,356,270 | B2 | 4/2008 | Matsusaka et al. |
| 7,359,666 | B2 | 4/2008 | Takashi et al. |
| 7,366,432 | B2 | 4/2008 | Kishi et al. |
| 7,369,803 | B2 | 5/2008 | Echigo et al. |
| 7,373,094 | B2 | 5/2008 | Kishi et al. |
| 7,433,641 | B2 | 10/2008 | Kikuchi et al. |
| 7,496,309 | B2 | 2/2009 | Matsusaka et al. |
| 7,515,845 | B2 | 4/2009 | Kishi et al. |
| 7,526,242 | B2 | 4/2009 | Takagaki et al. |
| 7,551,869 | B2 | 6/2009 | Kishi et al. |
| 7,565,087 | B2 | 7/2009 | Matsusaka et al. |
| 7,570,911 | B2 | 8/2009 | Nakafuji et al. |
| 7,583,922 | B2 | 9/2009 | Takashi et al. |
| 7,603,049 | B2 | 10/2009 | Kishi et al. |
| 7,609,988 | B2 | 10/2009 | Kishi et al. |
| 7,664,410 | B2 | 2/2010 | Takagi |
| 7,738,827 | B2 | 6/2010 | Someya et al. |
| 2003/0165348 | A1 | 9/2003 | Amita et al. |
| 2004/0037595 | A1 | 2/2004 | Takashi et al. |
| 2004/0245241 | A1 | 12/2004 | Kishi et al. |
| 2004/0247332 | A1 | 12/2004 | Kishi et al. |
| 2004/0247334 | A1 | 12/2004 | Kishi et al. |
| 2004/0258426 | A1 | 12/2004 | Kishi et al. |
| 2005/0025534 | A1 | 2/2005 | Fujita et al. |
| 2005/0025537 | A1 | 2/2005 | Echigo et al. |
| 2005/0117943 | A1 | 6/2005 | Nakafuji et al. |
| 2005/0139584 | A1 | 6/2005 | Kishi et al. |
| 2005/0152721 | A1 | 7/2005 | Kikuchi et al. |
| 2005/0158075 | A1 | 7/2005 | Echigo et al. |
| 2005/0175368 | A1 | 8/2005 | Matsusaka et al. |
| 2005/0175370 | A1 | 8/2005 | Matsusaka et al. |
| 2005/0191078 | A1 | 9/2005 | Kishi et al. |
| 2005/0201783 | A1 | 9/2005 | Kurotaka et al. |
| 2005/0207801 | A1 | 9/2005 | Kunii et al. |
| 2005/0286920 | A1 | 12/2005 | Baba et al. |
| 2006/0008302 | A1 | 1/2006 | Someya et al. |
| 2006/0013624 | A1 | 1/2006 | Kurotaka et al. |
| 2006/0019082 | A1 | 1/2006 | Kikuchi et al. |
| 2006/0029411 | A1 | 2/2006 | Ishii et al. |
| 2006/0039713 | A1 | 2/2006 | Kishi et al. |
| 2006/0051111 | A1 | 3/2006 | Kishi et al. |
| 2006/0051112 | A1 | 3/2006 | Matsusaka et al. |
| 2006/0051113 | A1 | 3/2006 | Kishi et al. |
| 2006/0051119 | A1 | 3/2006 | Kishi et al. |
| 2006/0051120 | A1 | 3/2006 | Kishi et al. |
| 2006/0051121 | A1 | 3/2006 | Matsusaka et al. |
| 2006/0088349 | A1 | 4/2006 | Someya et al. |
| 2006/0120776 | A1 | 6/2006 | Takashi et al. |
| 2006/0127118 | A1 | 6/2006 | Kishi et al. |
| 2006/0140689 | A1 | 6/2006 | Echigo et al. |
| 2006/0182460 | A1 | 8/2006 | Kishi et al. |
| 2007/0014600 | A1 | 1/2007 | Ishii et al. |
| 2007/0031159 | A1 | 2/2007 | Kishi et al. |
| 2007/0065188 | A1 | 3/2007 | Takagaki et al. |
| 2007/0104520 | A1 | 5/2007 | Nakafuji et al. |
| 2007/0212090 | A1 | 9/2007 | Matsusaka et al. |
| 2008/0145088 | A1 | 6/2008 | Matsusaka et al. |
| 2008/0219716 | A1 | 9/2008 | Takashi et al. |
| 2008/0253789 | A1 | 10/2008 | Yoshinaga et al. |
| 2009/0123172 | A1 | 5/2009 | Kishi et al. |
| 2009/0169232 | A1 | 7/2009 | Kunii et al. |
| 2009/0317113 | A1 | 12/2009 | Kishi et al. |
| 2010/0232818 | A1 | 9/2010 | Kunii |
| 2010/0290822 | A1 | 11/2010 | Hasegawa et al. |
| 2011/0026988 | A1 | 2/2011 | Yoshikawa et al. |
| 2011/0211886 | A1* | 9/2011 | Moore ..... 399/398 |

FOREIGN PATENT DOCUMENTS

| | | | |
|---|---|---|---|
| JP | 2003-233266 | A | 8/2003 |
| JP | 2004258537 | A | 9/2004 |
| JP | 2004325934 | A | 11/2004 |
| JP | 2006-030248 | A | 2/2006 |

* cited by examiner

GLOSS APPLICATOR AND IMAGE FORMING APPARATUS

CROSS-REFERENCE TO RELATED APPLICATIONS

This application claims priority to Japanese Patent Application No. 2010-020762, filed on Feb. 1, 2010 in the Japan Patent Office, which is incorporated by reference herein in its entirety.

BACKGROUND OF THE INVENTION

1. Field of the Invention

The present invention relates to a gloss applicator for an image forming apparatus such as a copier, a printer, a facsimile machine, a print machine, a plotter, and a multi-functional apparatus having a plurality of these functions. After a non-fused image is formed on a recording medium (hereinafter "sheet" or "paper") using image-forming powder particles (hereinafter "toner") and then the non-fused image is fused on the recording medium, the gloss applicator is used to enhance glossiness of the image.

2. Description of the Background Art

Image forming apparatuses such as copiers, facsimile machines, printers, or printing machines reproduce a copied image or recorded image by fusing a non-fused image on a recording sheet by applying heat to the non-fused image using various types of sheets as the recording media. As for full-color images in the form of photographs or computer graphics in particular, uniform image glossiness and high quality is increasingly demanded.

Thus, for example, JP-2004-325934-A discloses a method of adjusting glossiness of the image when output. Specifically, after conducting temporary fusing of the toner image on a recording medium, the recording medium is transported to an image glossiness adjustment unit disposed downstream from a fusing unit. The recording medium bearing the toner image is then contacted and pressed against an outer face of a flat member such as an endless belt, and transported for a given distance before separating the recording medium therefrom. With such process, the condition of the surface of the outer face of the flat member can affect the toner image to adjust an image condition, and then the adjusted image is output, in which a toner-image fused sheet, transported on the extended belt, is cooled using a cooling fin and/or a cooling fan disposed inboard and outboard of the extended belt, wherein an image-formed face of the sheet contacts the extended belt.

Similarly, JP-2004-258537-A and JP-2006-030248-A disclose methods of controlling a temperature at a face of the sheet on which the toner image is to be fused so as to adjust the glossiness of the output image.

Although it may be preferable to adjust the glossiness of the image depending on the type of sheet and/or image, the apparatus of JP-2004-325934-A cools all sheets the same way without adjustment for type of sheet and/or image. Further, the apparatuses of JP-2004-258537-A and JP-2006-030248-A adjust image glossiness based on the temperature at the fusing face of the sheet. However, it takes time to set a temperature effective for image forming at the speed of the oncoming recording media, which lengthens the waiting time to implement such temperature control.

SUMMARY

In one aspect of the invention, a gloss applicator, disposed downstream from a fusing device for fusing a non-fused image on a recording medium, is devised. The gloss applicator includes a pair of pressure units, an endless belt, and a belt suction unit. The pair of pressure units define a gloss nip therebetween through which the recording medium is passed to enhance glossiness of the fused image. The endless belt, disposed in one of the pressure units in an extended loop configuration, transports the recording medium thereon. An outer face of the endless belt can contact the fused image on the recording medium. The belt suction unit, disposed inside the endless belt loop, exerts suction on the endless belt to locally deform a given portion of the endless belt and separate the recording medium from the endless belt at the given portion as a separation position.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
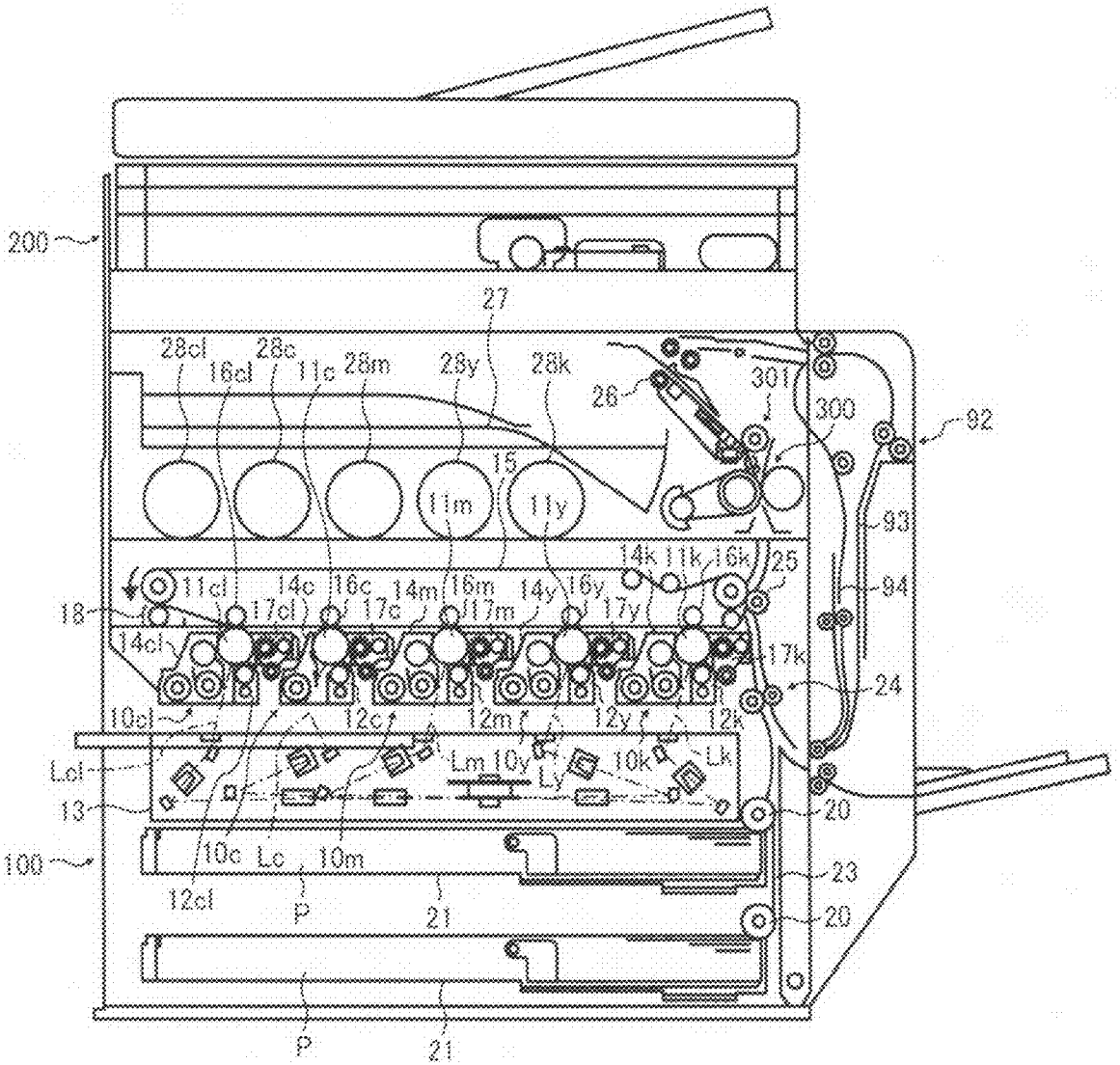
FIG. 1 shows a schematic configuration of an image forming apparatus according to a first example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner. Referring now to the drawings, image forming apparatuses according to example embodiments are described hereinafter.

First Example Embodiment

A description is now given to an image forming apparatus according to a first example embodiment with reference to FIGS. 1 to 6. FIG. 1 shows a schematic configuration an image forming apparatus according to a first example embodiment such as for example a color copier, but not limited thereto. The image forming apparatus may include an image forming unit 100 and an image scanner 200 disposed over the image forming unit 100 as shown in FIG. 1. The image forming unit 100 may include image forming stations arranged in tandem such as image forming stations 10*c*, 10*m*, 10*y*, 10*k* used for cyan, magenta, yellow, black image, respectively.

The image forming unit 100 may further include an image forming station 10*cl*, which may be disposed at the extreme upstream side of a moving direction of an intermediate transfer member 15. The image forming station 10*cl* is used to form a gloss face using clear toner on a recording medium. For example, clear toner may be applied to a white area, which may bean area not formed of image in an image forming area, or may be applied on an entire area of image forming area.

Each of the image forming stations 10*c*, 10*m*, 10*y*, 10*k* respectively includes photoconductors 11*cl*, 11*c*, 11*m*, 11*y*, 11*k* having a drum shape. When each of the photoconductors 11*cl*, 11*c*, 11*m*, 11*y*, 11*k* rotates in a clockwise direction in FIG. 1, a Surface of each of the photoconductors 11*cl*, 11*c*, 11*m*, 11*y*, 11*k* is uniformly charged by applying a bias voltage using each of chargers 12*cl*, 12*c*, 12*m*, 12*y*, 12*k*, respectively.

Then, an optical writing unit 13 emits each of laser beams Lcl, Lc, Lm, Ly, Lk to the photoconductors 11*cl*, 11*c*, 11*m*, 11*y*, 11*k*, respectively to conduct an optical writing process to form an electrostatic latent image on each of the photoconductors 11*cl*, 11*c*, 11*m*, 11*y*, 11*k* based on a signal transmitted to the optical writing unit 13. Such transmitted signal may be a scan signal generated by the image scanner 200 in a case of a copier, an image signal generated at a host computer (CP) in a case of a printer, and a signal transmitted via a phone line in a case of a facsimile machine, but not limited thereto.

Then, the electrostatic latent image is developed as a toner image (i.e., visualized image) by each of development units 14*cl*, 14*c*, 14*m*, 14*y*, 14*k* using toner to form a single color image on each of the photoconductors 11*cl*, 11*c*, 11*m*, 11*y*, 11*k*.

The intermediate transfer member 15, which may be an endless belt, may contact the photoconductors 11*cl*, 11*c*, 11*m*, 11*y*, 11*k* and move in a counter-clockwise direction in FIG. 1. When the intermediate transfer member 15 is being moved, the single color image formed on the photoconductors 11*cl*, 11*c*, 11*m*, 11*y*, 11*k* is sequentially transferred from the photoconductors 11*cl*, 11*c*, 11*m*, 11*y*, 11*k* to the intermediate transfer member 15 with an effect of each of primary transfer devices 16*cl*, 16*c*, 16*m*, 16*y*, 16*k*, in which a clear toner may be transferred at first, and then C, M, Y, K toner images are transferred, by which images are superimposed and transferred on the intermediate transfer member 15 to form a full color image (primary transfer process).

Further, in the image forming unit 100, one of sheet feed rollers 20 selectively rotates at a given timing to feed out a recording medium P, matched to a size of output image, from a sheet cassette 21 storing sheets, and the recording medium P is transported to a registration roller 24 having a pair of rollers via sheet transport route 23, and the recording medium P is abutted and stopped at the registration roller 24. Hereinafter, the recording medium P may be also referred to as sheet P.

The registration roller 24 rotates at a given timing synchronized with a timing of forming the full color image on the intermediate transfer member 15 to feed the sheet P to a secondary transfer nip so that the full color image is transferred to the sheet P with an effect of a secondary transfer device 25 (secondary transfer process).

After a secondary transfer process of full color image, the sheet P is transported to a fusing device such as a fusing unit 300 through the sheet transport route 23. When the sheet P passes through a fusing nip of the fusing unit 300, the full color image (i.e., non-fixed image) is fused on the sheet P.

When a mode to enhance glossiness of image is selected or when a specific type of sheet is used, a gloss nip may be set in a gloss applicator 301 to pass the sheet P through the gloss nip, and then the sheet P is stacked on an ejected sheet stack 27 of the image forming unit 100. On one hand, when a glossiness application by the gloss applicator 301 is not conducted to the sheet P, a gloss application belt 30 and a second pressure unit 40 (to be described later) are separated so that a gloss nip is not set in the gloss applicator 301, and the sheet P is ejected without receiving an glossiness application operation. The term of "gloss nip" is used in this disclosure to distinguish a nip in the gloss applicator 301 from the "fusing nip" in the fusing unit 300.

After the primary transfer process, each of the photoconductors 11*cl*, 11*c*, 11*m*, 11*y*, 11*k* is cleaned by the primary cleaning units 17*cl*, 17*c*, 17*m*, 17*y*, 17*k*, respectively, to remove toner remaining after the primary transfer process, by which each of the photoconductors 11*cl*, 11*c*, 11*m*, 11*y*, 11*k* can be set ready for a next image forming operation.

Further, after the secondary transfer process, the intermediate transfer member 15 is cleaned by a secondary cleaning unit 18 to remove toner remaining after the secondary transfer process, by which the intermediate transfer member 15 can be set ready for a next image forming operation. In FIG. 1, each of toner bottles 28*cl*, 28*c*, 28*m*, 28*y*, 28*k* is used to re-fill toner to each of the development units 14*cl*, 14*c*, 14*m*, 14*y*, 14*k*.

Further, although the image forming apparatus may be used to record a full color image on the sheet P as above described, the image forming apparatus can be used in different ways. For example, when a single color mode or a multicolor mode is selected for the image forming apparatus, one or more the image forming stations 10*c*, 10*m*, 10*y*, 10*k* are selectively used to form a monochrome image or color image.

Further, the image forming apparatus includes a configuration to apply glossiness on the sheet P using clear toner as above described to suppress an overall imbalance of glossiness between an image formed area on the sheet P and a white area having no image and having no glossiness, in which clear toner is applied to the white area to set a given level of glossiness on the white area. However, the image forming station 10*cl* may not be activated in given conditions, or the image forming apparatus can be configured with a usual tandem configuration using four colors without the image forming station 10*cl* for applying clear toner.

Figure 2:
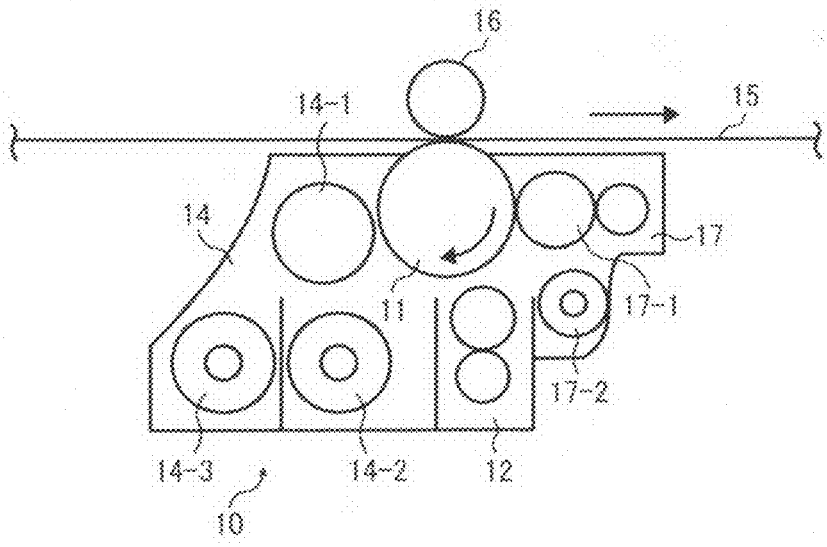
FIG. 2 shows an expanded view of an image forming station of FIG. 1.

FIG. 2 shows an expanded view of each of the image forming stations 10*c*, 10*m*, 10*y*, 10*k* having the same configuration, in which the development unit 14 may include a development roller 14-1, two agitation/transportation members 14-2 and 14-3 to circulate developer such as toner. The primary cleaning unit 17 may include a cleaning roller 17-1 such as for example a brush roller and a recovery roller 17-2.

Figure 3:
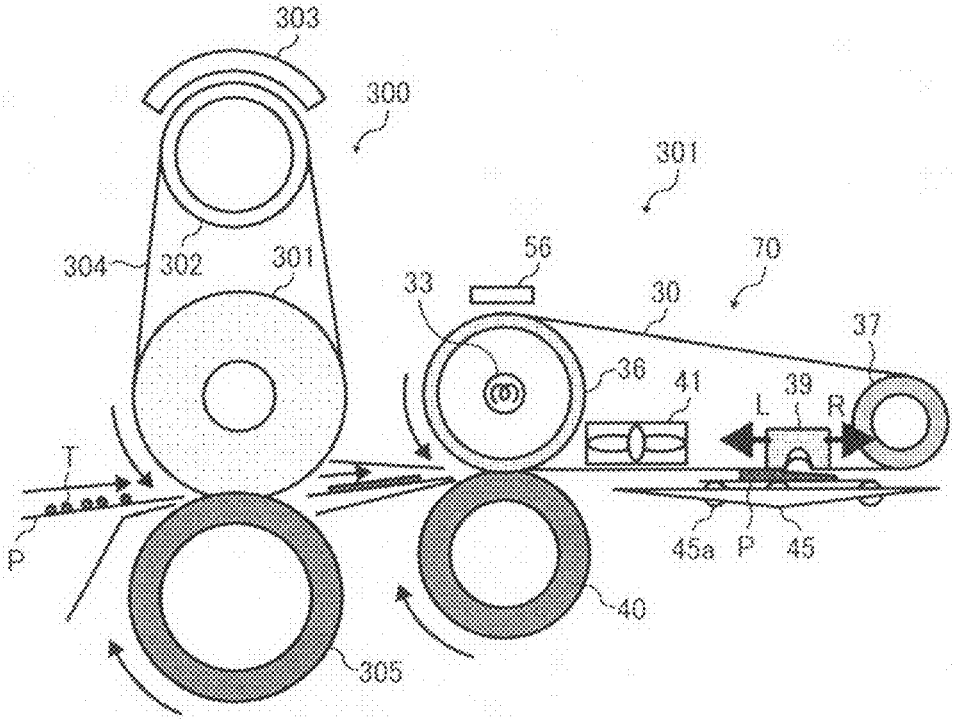
FIG. 3 shows a schematic configuration of a fusing device and a gloss applicator according to a first example embodiment.

A description is now given to a configuration of the fusing unit 300 and the gloss applicator 301 with reference to FIG. 3. Specifically, the fusing unit 300 may include a fusing roller 301, a heating roller 302, a heating device 303, a fusing belt 304, and a pressure roller 305. The heating device 303 heats the heating roller 302 using, for example, an electromagnetic induction system, but not limited thereto. The fusing belt 304 may be an endless belt extended by the fusing roller 301 and the heating roller 302. The pressure roller 305 can be pressed toward and against the fusing roller 301 via the fusing belt 304 to form a fusing nip between the pressure roller 305 and the fusing roller 301. A heating system or method of the fusing unit 300 is not limited to the electromagnetic induction system, but other system or method can be used. For example, the heating device 303 may be configured as a usual heat source such as heater that directly heats the fusing belt 304, in which the heating roller 302 may only function as a support roller.

The gloss applicator 301 may include a pair of pressure units such as a first pressure unit 70 and a second pressure unit 40, disposed downstream from a sheet transportation direction with respect to the fusing unit 300. The first pressure unit 70 and second pressure unit 40 can set a gloss nip therebetween.

The first pressure unit 70 may include a heating roller 36, a tension roller 37, a gloss application belt 30 extended by the heating roller 36 and the tension roller 37. The gloss application belt 30, used as gloss application member may be, for example, an endless belt, which may be formed as belt loop.

The second pressure unit 40 used as a pressure member is disposed at a position opposing the heating roller 36 via the gloss application belt 30. The second pressure unit 40 can be pressed toward and against the heating roller 36 via the gloss application belt 30 to set a gloss nip therebetween. The second pressure unit 40 may be, for example, a pressure roller. Hereinafter, the second pressure unit 40 may be referred to as pressure roller 40.

The heating roller 36 may include a heater 33 such as a halogen heater as a heat source inside the heating roller 36. A non-contact temperature sensor 56 monitors temperature of a surface layer of the gloss application belt 30, and a controller 74 (see FIG. 6) controls the temperature of a surface layer of the gloss application belt 30 at a constant level.

The heating roller 36 may be configured with a metal roller made of metal such as aluminum (Al), stainless (SUS), or iron (Fe) having a given outside diameter such as ϕ 30 mm to ϕ 50 mm. Further, an elastic layer, made of resin such as silicone rubber having a given thickness such as 0.5 mm to 2 mm, may be fixed on a surface of metal roller to set a wider gloss nip between the heating roller 36 and the pressure roller 40. It should be noted that the heating roller 36 could be configured using other materials, sizes, and shapes besides those described above.

The gloss application belt 30 may be made of a heat-resistant resin such as polyimide having a given thickness such as 10 μm to 200 μm, or a metal such as nickel, stainless (SUS), or the like. The gloss application belt 30 has a given size such as a width of 80 mm to 300 mm, for example. It should be noted that the gloss application belt 30 is not limited to the materials and dimensions described above and can be configured using other materials, sizes, and shapes besides those described above.

Optionally, the surface layer of the gloss application belt 30 may include an affinity-enhancing elastic layer to enhance a contact affinity between the gloss application belt 30 and an image-formed face of sheet transported from the fusing unit 300. For example, the affinity-enhancing elastic layer may be made of resin such as silicone rubber having a given thickness such as 5 μm to 50 μm to enhance a close contact between the belt and the image-formed face.

The tension roller 37 may have a given outside diameter such as ϕ 10 mm to ϕ 30 mm, and made of metal such as iron (Fe), aluminum (Al), and stainless (SUS). It should be noted that the tension roller 37 is not limited to the materials and dimensions described above and can be configured using other materials and sizes.

Further, a sheet ejection guide 45 may be disposed under the gloss application belt 30 to eject the sheet P separated from the gloss application belt 30. The sheet ejection guide 45 may include a plurality of rollers 45*a*, which contacts and guides the sheet P.

Further, a cooling fan 41 may be disposed inside the loop of gloss application belt 30 as a cooling device, and based on an inside surface temperature of the gloss application belt 30 detected by a temperature sensor, the controller 74 controls air volume and/or wind speed of the cooling fan 41. The cooling device is not limited to a specific configuration. For example, a heat sink, a fan, a heat pipe, or a peltier device can be used as a cooling device either alone or in combination to cool the gloss application belt 30.

Further, a belt suction duct 39 is disposed inside the gloss application belt 30 as a belt suction unit, in which the belt suction duct 39 is connected to an air suction source 72 (see FIG. 4) used as a suction source. The belt suction duct 39 has a suction concavity 39*a* having an arc shape, which is shown as a side view of the suction concavity 39*a* in FIG. 4. The belt suction duct 39 may have a substantially same width of the gloss application belt 30 in a sheet width direction perpendicular to a transport direction of the sheet P. The belt suction duct 39 is moveable in a direction shown by arrows in FIG. 3. Specifically, the belt suction duct 39 can be moved between the upstream position and the downstream position of belt moving direction (or between the front position and rear position of sheet transport direction). A drive unit 76 (see FIG. 6) can be used to move the belt suction duct 39 between the upstream position and the downstream position of belt moving direction, in which the drive unit 76 may be, for example, a screw-type drive unit, a belt-type drive unit using a timing belt and timing pulley, but not limited thereto.

Figure 4:
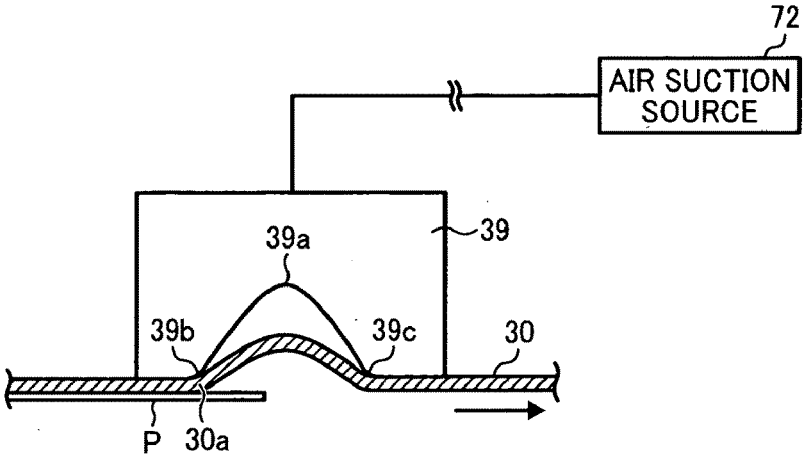
FIG. 4 shows a schematic configuration of a belt suction unit and suction operation.

When the air suction source 72 is activated, an air pressure in the suction concavity 39*a* of belt suction duct 39 can be reduced, by which depressurized condition, in particular vacuumed condition, occurs in the belt suction duct 39. By using such depressurized condition such as depressurized air condition, the belt suction duct 39 can exert suction of the gloss application belt 30. Specifically, the belt suction duct 39 can exert suction of the gloss application belt 30 from the inside face of the gloss application belt 30, by which a given shape such as an arc shape can be locally formed on the gloss application belt 30 as shown in FIG. 4, and the gloss application belt 30 is rotated and transported while maintaining such arc shape. As such, the belt suction duct 39 can exert suction using the depressurized gas such as air.

As shown in FIG. 4, the suction concavity 39*a* is formed for the belt suction duct 39 to form a given shape such as an arc shape by exerting suction of the gloss application belt 30, and the gloss application belt 30 moves while maintaining such arc shape. Each of corners 39*b* and 39*c* of the suction concavity 39*a*, which contacts the gloss application belt 30, is formed in a mild warp shape or rounded shape to reduce a contact friction between the belt suction duct 39 and the gloss application belt 30. With an effect of such warped arc shape of the gloss application belt 30, a separating position (or portion) 30*a* having a greater curvature can be formed on the gloss application belt 30, and the sheet P can be separated at the separating position 30*a*.

The pressure roller 40 has a given outer diameter such as ϕ 30 mm to ϕ 50 mm, and includes a metal core made of iron (Fe), aluminum (Al), stainless (SUS) or the like, an elastic layer formed on the metal core with a given thickness such as 1 mm to 30 mm, which may be made of resin such as fluoric rubber, silicone rubber or the like, and a most-outer layer having a given thickness such as 5 μm to 50 μm made of resin such as fluoro-chemicals or the like, in which the most-outer layer is used as a separation layer.

The pressure roller 40 can be engaged and disengaged with respect to the gloss application belt 30 using a cam. By changing a shaft-to-shaft distance between the heating roller 36 and pressure roller 40, a gloss-nip width and a gloss-nip load can be controlled variably.

Further, the pressure roller 40 is connected to a motor. When the pressure roller 40 is rotated by driving force of the motor, the heating roller 36, the gloss application belt 30, and the tension roller 37 can be also rotated by following a rotation of the pressure roller 40.

When gloss is not applied to the sheet P, the pressure roller 40 is separated from the gloss application belt 30, in which the gloss applicator 301 is only used as a sheet transport route.

A print operation may be conducted as follows: A print signal is input, and then an image is transferred to the sheet P using the image forming station. When the sheet P passes through the fusing unit 300, a toner image is fused on the sheet P, then the sheet P passes through a gloss nip set between the heating roller 36 and the pressure roller 40 via the gloss application belt 30. At the gloss nip, in addition to pressure, heat may be applied by the gloss application belt 30, and the sheet P is transported while maintaining a close contact with the gloss application belt 30.

When the sheet P enters the gloss nip, a face of sheet P having a fused-image is heated, and the sheet P is transported while maintaining a close contact with the gloss application belt 30, and cooled by the cooling fan 41. As such, the gloss application belt 30 may have a function of transporting the sheet P. The belt suction duct 39 can be moved in a given direction and stopped at a given position, which is determined based on a glossiness of sheet P, a sheet weight such as paper weight of sheet P, or a glossiness value set by a user discretionary.

Figure 5:
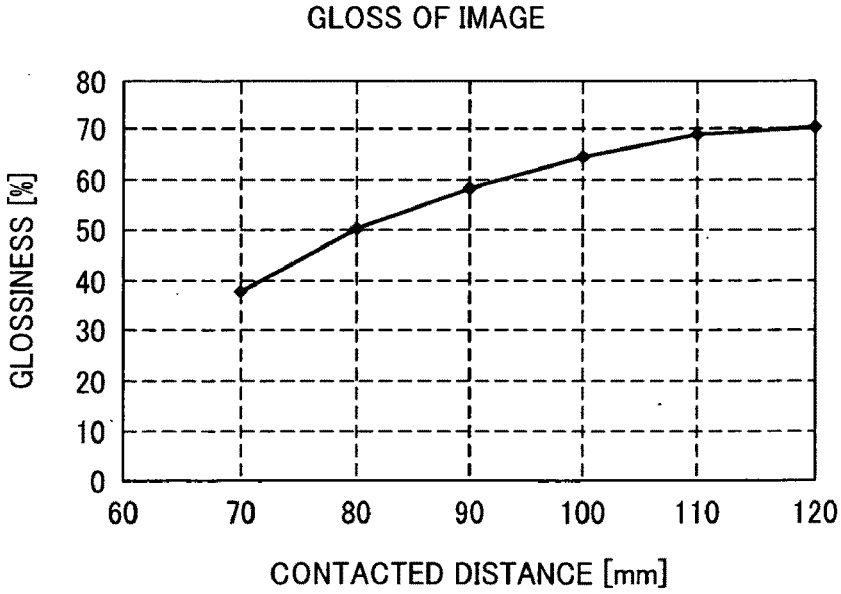
FIG. 5 shows a characteristic curve indicating a relation between belt contacted distance and glossiness.

FIG. 5 shows a relation between image glossiness and a contacted distance of image contacted with the gloss application belt 30. Such contacted distance of image indicates how long the image on the sheet P is in contact with the gloss application belt 30. Accordingly, the image on the sheet P is separated from the gloss application belt 30 at the end of the contacted distance. The longer the contacted distance, the lower the temperature of the image when separated from the gloss application belt 30. The lower the temperature of the image when separated from the gloss application belt 30, the higher the glossiness of toner image. Glossiness is applied to a toner image fused on the sheet P when the melted toner image, fused on the sheet P, is solidified while in contact with the gloss application belt 30 because the surface of the sheet P which bears the solidified toner image can be smoothed by contacting the surface of the gloss application belt 30.

For example, when a lower glossiness is desired, the belt suction duct 39 is moved to the left in FIG. 3 as shown by an arrow L, and then the belt suction duct 39 can exert suction of the gloss application belt 30 to arch the gloss application belt 30. As a result, the image on the sheet P, transported while remaining in a close contact with the belt suction duct 39, is separated from the gloss application belt 30 by the curvature at the arc shape. Because a cooling time of the image shrinks in this case, the temperature of the image on the sheet P when the sheet P is separated from the belt suction duct 39 is relatively high, thereby reducing the glossiness of the image.

On one hand, when a higher glossiness is desired, the belt suction duct 39 is moved to the right in FIG. 3 as shown by an arrow R, and then the belt suction duct 39 can exert suction of the gloss application belt 30 to arch the gloss application belt 30. As a result, the image on the sheet P, transported while remaining in a close contact with the belt suction duct 39, is separated from the gloss application belt 30 by the curvature at the arc shape. Because a cooling time of image becomes longer in this case, the temperature of the image on the sheet P when the sheet P is separated from the belt suction duct 39 is relatively low, thereby increasing the glossiness of the image to a higher level. Further, when to obtain a highest glossiness for the image, the belt suction duct 39 is set at a position most close to the tension roller 37, and the image on the sheet P is separated at such position.

Figure 6:
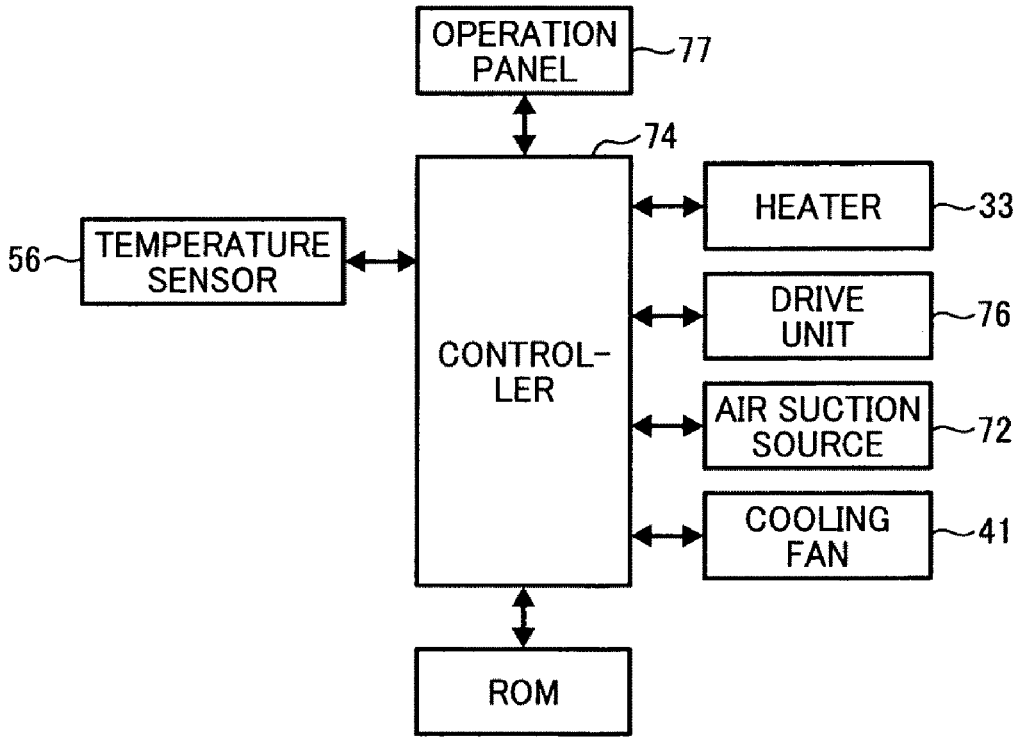
FIG. 6 shows a block diagram of a control system according to a first example embodiment.

Relation of glossiness and sheet weight (e.g., paper weight) of sheet P or glossiness value set by a user discretionary, and a position setting of the belt suction duct 39 can be determined in advance, and, for example, such information may be stored in a read only memory (ROM) shown in FIG. 6 as control data table. When a condition is input from an operation panel 77, the controller 74 extracts a position setting value for the belt suction duct 39, corresponding to the input condition, from the control data table, and then controls a driving of the drive unit 76.

In a conventional configuration, the temperature of image to be separated from the gloss application belt 30 is controlled by using only the cooling fan 41, in which a power to operate the cooling fan 41 needs to be changed to control the temperature of image at a given level, and thereby it takes a longer time to set a given temperature when separating the image from the belt.

In the above described example embodiment, a separation position of sheet P can be variably set while maintaining a power to operate the cooling fan 41 at a constant level (i.e., constant cooling power). Accordingly, the sheet P can be separated by setting a cooling distance of image (or separation position of image) with a'given temperature setting, and by which a glossiness of image can be variably controlled to a given level quickly.

Second Example Embodiment

Figure 7:
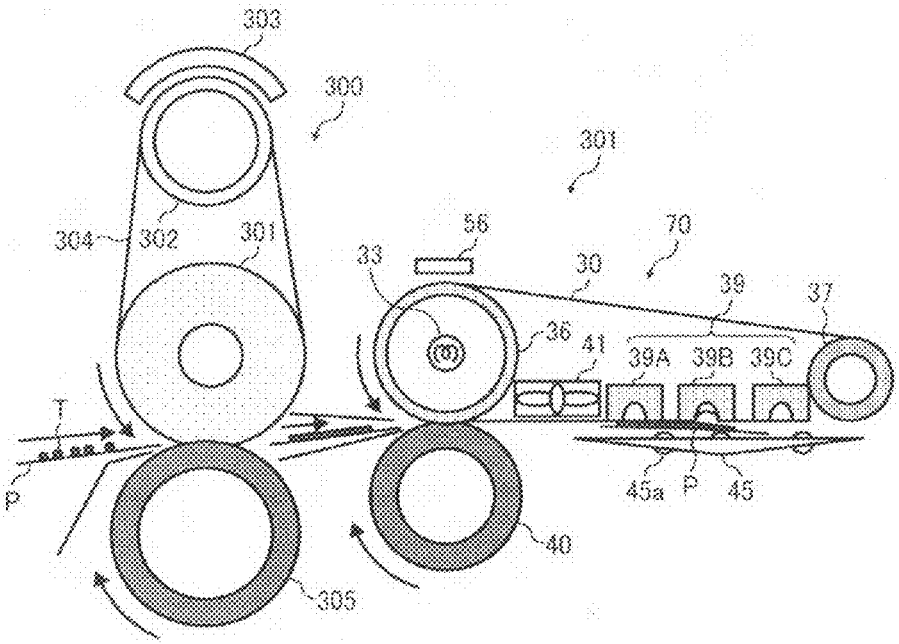
FIG. 7 shows a schematic configuration of a fusing device and a gloss applicator according to a second example embodiment.
Figure 8:
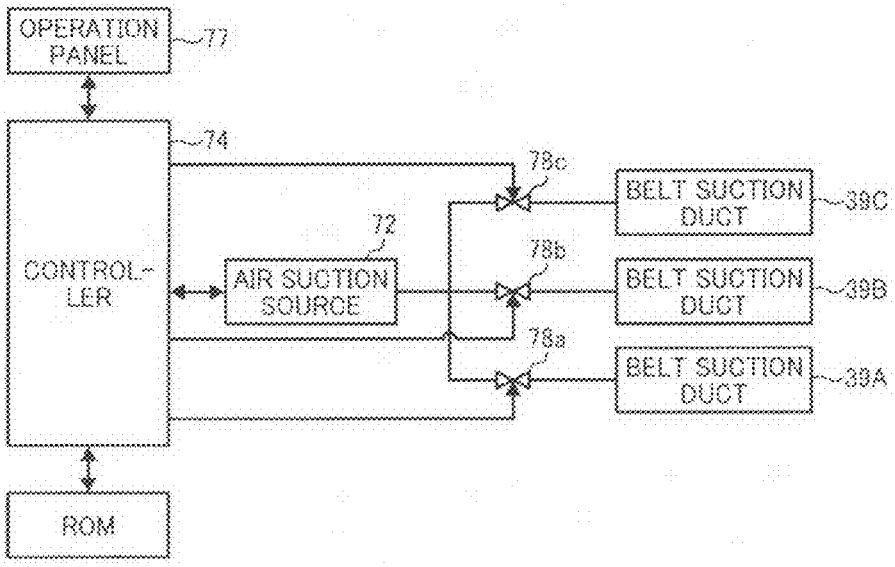
FIG. 8 shows a block diagram of a control system according to a second example embodiment.

A description is now given to a second example embodiment according to the present invention with reference to FIGS. 7 and 8. The members, units, or the like, which are described in the first example embodiment may be referred in the second example embodiment by attaching same numerals or signs, and configuration and function of the same members, units, or the like may not be explained, or may be explained briefly.

In the second example embodiment, as shown in FIG. 7, a plurality of belt suction units is disposed along a moving direction of the gloss application belt 30 by setting a given interval between the belt suction units. For example, three belt suction ducts may be disposed as shown in FIG. 7, but the number of belt suction ducts is not limited thereto. As shown in FIG. 8, each of belt suction ducts 39A, 39B, 39C is connected to the air suction source 72 via air valves 78*a*, 78*b*, 78*c*, respectively, in which a suction operation can be selectively conducted by controlling opening/closing of air valves disposed for each of belt suction ducts.

Relation of glossiness and sheet weight (e.g., paper weight) of sheet P, glossiness value set by a user discretionary, and a position setting (or position moving) of the belt suction duct 39 can be determined in advance, and such information may be stored, for example, in a read only memory (ROM) shown in FIG. 8 as control data table. When a condition is input from an operation panel 77, the controller 74 selects a belt suction duct matched to the input condition, and opens an air valve for the selected belt suction duct and closes other air valves.

A print operation may be conducted as follows: A print signal is input, and then an image is transferred to the sheet P using the image forming station. When the sheet P passes through the fusing unit 300, a toner image is fused on the sheet P, then the sheet P passes through a gloss nip set between the heating roller 36 and the pressure roller 40 via the gloss application belt 30. At the gloss nip, in addition to pressure, heat may be applied by the gloss application belt 30, and the sheet P is transported while maintaining a close contact with the gloss application belt 30.

When the sheet P enters the gloss nip, a face of sheet P having a fused-image is heated, and the sheet P is transported while maintaining a close contact with the gloss application belt 30, and cooled by the cooling fan 41. Based on glossiness of sheet P itself, sheet weight (e.g., paper weight) of sheet P, an/or glossiness value set by a user discretionary, one of the belt suction ducts 39 is selected and activated for conducting a suction operation.

For example, when a lower glossiness is desired, the belt suction duct 39A, disposed at the extreme upstream of a belt-moving direction, is selected, and then the belt suction duct 39A can exert suction of the gloss application belt 30 to arch the gloss application belt 30. As a result, the image on the sheet P, transported while remaining in a close contact with the gloss application belt 30, is separated from the gloss application belt 30 by the curvature at the arc shape. Because a cooling time of the image shrinks in this case, the temperature of the image on the sheet P when the sheet P is separated from the belt suction duct 39 is relatively high, thereby reducing the glossiness of the image.

On one hand, when a higher glossiness is desired, the belt suction duct 39C, disposed at the extreme downstream of a belt-moving direction, is selected, and then the belt suction duct 39C can exert suction of the gloss application belt 30 to arch the gloss application belt 30. As a result, the image on the sheet P, transported while remaining in a close contact with the belt suction duct 39, is separated from the gloss application belt 30 by the curvature at the arc shape. Because a cooling time of image becomes longer in this case, the temperature of the image on the sheet P when the sheet P is separated from the belt suction duct 39A is relatively low, thereby increasing the glossiness of the image to a higher level. Further, when to obtain a highest glossiness for the image, each of the belt suction ducts 39 is not activated, and the image on the sheet P is separated at the tension roller 37.

In the second example embodiment, the drive unit 76 used in the first example embodiment can be omitted, and a position of the belt suction duct 39 used for a suction operation can be set by just controlling any one of air valves. Accordingly, glossiness of image can be controlled to a given level within a shorter time, which means a separation position of image can be set within a shorter time.

Third Example Embodiment

Figure 9:
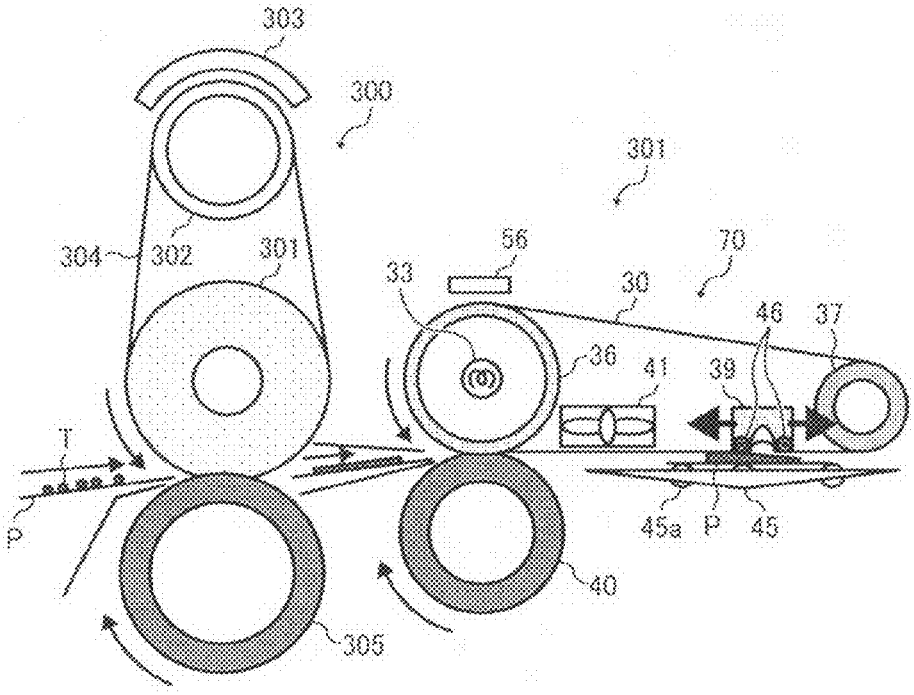
FIG. 9 shows a schematic configuration of a fusing device and a gloss applicator according to a third example embodiment.
Figure 10:
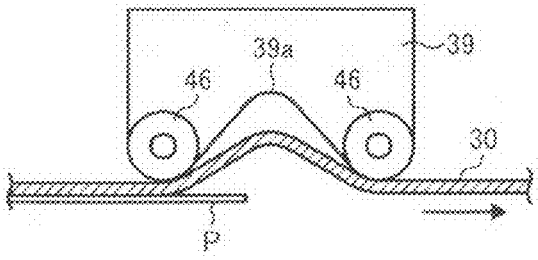
FIG. 10 shows an expanded view of a belt suction unit according to a third example embodiment.

A description is now given to a third example embodiment according to the present invention with reference to FIGS. 9 and 10. As shown in FIGS. 9 and 10, the third example embodiment may have a configuration similar to the first example embodiment. However, in the third example embodiment, a roller 46 is disposed as a rotatable member at a corner of suction concavity 39*a*, which is an edge of the belt suction duct 39. By disposing the roller 46 at a contact position between the gloss application belt 30 and the belt suction duct 39, a contact friction between the gloss application belt 30 and the belt suction duct 39 can be reduced, by which transportation of the gloss application belt 30 can be conducted reliably, and further, durability of the gloss application belt 30 can be enhanced.

Fourth Example Embodiment

Figure 11:
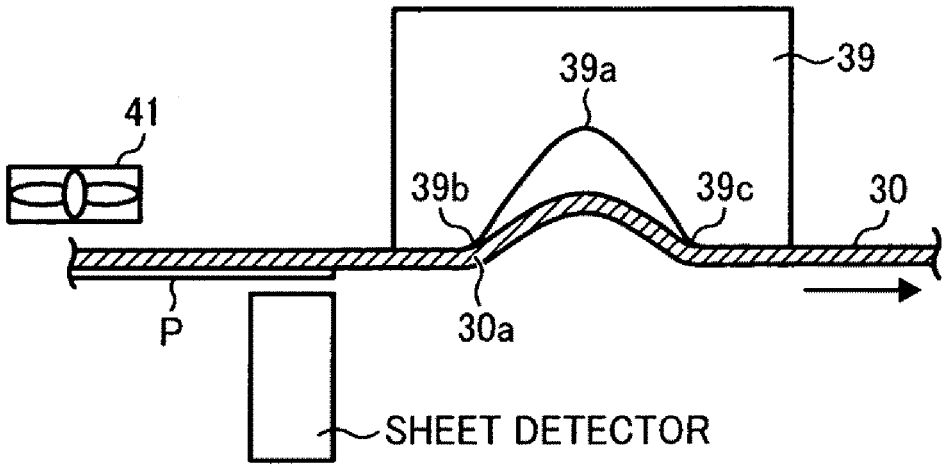
FIG. 11 shows an example configuration of a belt suction unit provided with a sheet detector.

A description is now given to a fourth example embodiment according to the present invention with reference to FIG. 11. In the fourth example embodiment, a sheet detector (see FIG. 11) such as a sheet sensor is disposed at a given position to detect a leading edge of sheet P. For example, the sheet detector may be disposed at a position just before the sheet P comes to or reaches a position of the belt suction duct 39, and a suction operation may be started when the leading edge of sheet is detected by the sheet sensor. The sheet detector may be disposed at a given position nearby the belt suction duct 39, disposed at the extreme upstream end of the belt transport direction, in view of setting a condition for a preferable suction operation.

With such a configuration, the belt suction unit can be activated for a suction operation when a leading edge of sheet is to come to a position of the belt suction unit, by which a contact time between the gloss application belt 30 and the belt suction duct 39 can be shortened. Further, a transportation of the gloss application belt 30 can be conducted reliably, and durability of the gloss application belt 30 can be enhanced. Further, because a suction operation is not to be conducted continuously in such a configuration, abrasion of the gloss application belt 30 can be reduced, and saving of electric power can be also attained. The fourth example embodiment can be combined with other example embodiments.

Fifth Example Embodiment

Figure 12A:
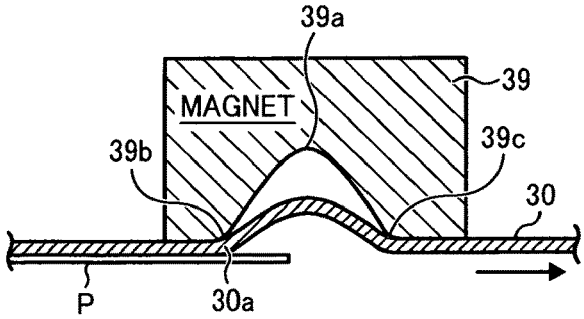
FIGS. 12A and 12B show a belt suction unit including a magnet entirely or partially.
Figure 12B:
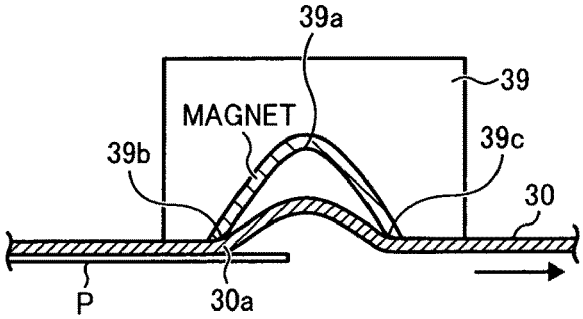
Figure 12C:
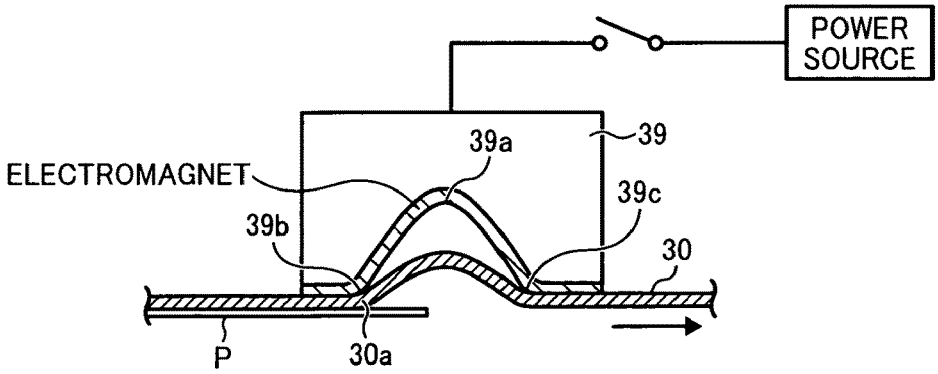
FIG. 12C shows a belt suction unit including an electromagnet.

A description is now given to a fifth example embodiment according to the present invention with reference to FIGS. 12A, 12B, and 12C. In the fifth example embodiment, a base member of the gloss application belt 30 may be made of a magnetic material such as for example nickel (Ni), or made of a member having magnetic material dispersed in the member. Further, a magnet unit shaped in a similar shape of the belt suction duct 39 may be disposed as belt suction unit. For example, the belt suction unit used as the magnet unit may include a magnet in an entire portion of the magnet unit (see FIG. 12A), or at a peripheral of magnet unit such as a corner end, or an arch portion of magnet unit (see FIG. 12B). As similar to a suction force caused by an air pressure difference at the belt suction duct 39, the gloss application belt 30 can be attracted to the magnet unit by closing a distance between the magnet unit and the gloss application belt 30 by an effect of magnetic force between the gloss application belt 30 and the magnet unit, and a deformation such as an arc shape may be formed locally on the gloss application belt 30. The curvature of arc shape of the gloss application belt 30 can be changed by changing the distance between the magnet unit and the gloss application belt 30. It should be noted that the size, shape, and/or position of magnet is not limited to the above, but can be changed.

Further, the magnet unit may include an electromagnet (see FIG. 12C), in which a magnetic power can be switched between ON and OFF by switching ON/OFF of electric current to the electromagnet. The electromagnet may be known magnets such as ferrite magnet or the like. In view of magnetic force and thermal resistance, neodymium magnet such as neodymium-iron-boron (Nd—Fe—B) may be preferably used at 80 degrees Celsius or less. Further, samarium-cobalt magnet (Sm—Co) that can be used at a high temperature such as 350 degrees Celsius or less may be used. Because samarium-cobalt magnet (Sm—Co) has a relatively smaller magnetic force, a volume of magnet is set greater to obtain a required level of magnetic force. It should be noted that the size, shape, and/or position of electromagnet is not limited to the above, but can be changed. The fifth example embodiment can be applied to the other example embodiments. Further, the above described example embodiments can be used in alone or combination.

In the above described example embodiments, the gloss applicator can set a requested or required glossiness level discretionally, and a control time for applying glossiness can be shortened, and an image forming apparatus having the gloss applicator can be devised.

In the above described example embodiments, a sheet can be separated at a given position using the belt suction unit, glossiness can be changed depending on a glossiness of sheet itself, sheet weight (e.g., paper weight), and/or glossiness value set by a user discretionary, and a control time for applying glossiness can be shortened. Further, a member that contacts a belt surface can be omitted, by which an occurrence of scratch on the belt surface can be prevented.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A gloss applicator, disposed downstream from a fusing device for fusing a non-fused image on a recording medium, the gloss applicator comprising:

a pair of pressure units to define a gloss nip therebetween through which the recording medium is passed to enhance glossiness of the fused image;

an endless belt, disposed in one of the pressure units in an extended loop configuration, to transport the recording medium thereon, an outer face of the endless belt contacting the fused image on the recording medium; and a belt suction unit, disposed inside the endless belt loop, to exert suction on the endless belt to locally deform a given portion of the endless belt and separate the recording medium from the endless belt at the given portion as a separation position.

2. The gloss applicator of claim 1, wherein the belt suction unit is moveable between an upstream position and a downstream position in a moving direction in which the endless belt moves.

3. The gloss applicator of claim 1, wherein the belt suction unit is configured as a plurality of belt suction units disposed-inside the endless belt loop along the moving direction in which the endless belt moves, and the separation position at which the recording medium is separated from the endless belt is changeable in the moving direction in which the endless belt moves by selective activation of one of the plurality of belt suction units.

4. The gloss applicator of claim 1, wherein the belt suction unit has a contact portion to contact the endless belt, and the contact portion has a given shape to reduce a friction between the belt suction unit and the endless belt.

5. The gloss applicator of claim 4, wherein the contact portion includes a rotatable member.

6. The gloss applicator of claim 4, wherein the belt suction unit has a rounded contact portion that contacts the endless belt to reduce friction between the belt suction unit and the endless belt.

7. The gloss applicator of claim 1, wherein the belt suction unit is activated when a leading edge of a recording medium sheet transported by the endless belt is to reach the belt suction unit.

8. The gloss applicator of claim 1, wherein the belt suction unit uses depressurized gas to exert suction on the endless belt.

9. The gloss applicator of claim 1, wherein the belt suction unit is a magnet unit having a magnet, in which a magnetic force is used to attract the endless belt.

10. The gloss applicator of claim 1, further comprising a cooling device, disposed inside the endless belt loop at a position after the gloss nip and before the belt suction unit, to cool the endless belt.

11. An image forming apparatus, comprising the gloss applicator of claim 1.

* * * * *